US005108148A

United States Patent [19]

Henke

[11] Patent Number: 5,108,148

[45] Date of Patent: Apr. 28, 1992

[54] RECLINING CHAIR MECHANISM HAVING SOLE SUPPORT PIVOT

[76] Inventor: Franz J. Henke, General Delivery, Alma, Ontario, Canada, N0B 1A0

[21] Appl. No.: 578,438

[22] Filed: Sep. 7, 1990

[51] Int. Cl.[5] ..... A47C 1/02; A61G 15/00

[52] U.S. Cl. ..... 292/81; 297/317; 297/321; 297/323; 297/436

[58] Field of Search ..... 297/78, 80–85, 297/87, 316, 317, 321, 390–392, 429, 433, 436, 323, DIG. 10, 306, 300, 354, 355

[56] References Cited

U.S. PATENT DOCUMENTS

| | | | |
|---|---|---|---|
| 27,663 | 3/1860 | Woodbury | 297/78 |
| 248,656 | 10/1881 | Koken et al. | 297/80 |
| 358,326 | 2/1887 | Berninghaus | 297/80 |
| 723,465 | 3/1903 | Horning | 297/80 |
| 1,510,376 | 9/1924 | Berninghaus | 297/80 |
| 3,727,974 | 4/1973 | Swenson et al. | 294/300 |
| 4,877,291 | 10/1989 | Taylor | 297/321 |

*Primary Examiner*—Kenneth J. Dorner
*Assistant Examiner*—James M. Gardner
*Attorney, Agent, or Firm*—R. Craig Armstrong

[57] ABSTRACT

An essentially self-balancing reclining chair is provided. The invention may be adapted to for use by any individual, regardless of size, shape or weight. The chair has a base and two parallelogram linkages spaced apart from and facing each other in parallel vertical planes. Each parallelogram linkage has upper, lower, front and rear linkage arms pivotally connected to each other to define the parallelogram. A back support is mounted behind and between the rear linkage arms, a seat support is suspended below and between the lower linkage arms, and a leg support is suspended below and between the front linkage arms. The upper linkage arms are pivotally connected to the base, such that the chair may be balanced by positioning the pivotal connection at a position corresponding to the approximate center of gravity of the chair and an average person. The pivoting points between the back support and the seat support are aligned with the person's hip joints. The pivoting points between the seat support and the leg support are aligned with the person's knee joints. The pivoting points between the rear and upper linkage arms are at the center of a quarter circle defined by the person's center of gravity in moving from an upright to horizontal position.

3 Claims, 10 Drawing Sheets

RECLINING CHAIR MECHANISM HAVING SOLE SUPPORT PIVOT

BACKGROUND OF THE INVENTION

This invention relates to a mechanism for a reclining chair, useful for a wide variety of seating applications.

The basic requirements of the ideal reclining mechanism are as follows:

a. There should be zero-shear movement between the person's body and the chair, such that there is no sliding between the body and the chair in any position;

b. There should be zero shear force between the body and the chair. The recline of the back support must be in an exact ratio to the incline of the seat support. Again, there should be no sliding or sense of sliding between the body and the chair;

c. The center of gravity for the body and the chair should stay in one location for any chair position (no vertical or horizontal movement of the gravity center from sitting to fully reclined), since any movement of the center of gravity vertically would require outside forces (springs, motors, etc.) to compensate for the different reclining positions, and any horizontal movement of the center of gravity requires an extension of the length of the support base;

d. The body and the chair parts should be in balance with each other, in any position.

The ideal solution to these requirements should result in a reclining chair design with a minimum number of actual parts, regardless of the complexity of the design theory.

SUMMARY OF THE INVENTION

It is an object of the invention to provide an improved reclining chair mechanism, to provide or approximate the ideal solution to the requirements mentioned above.

The invention thus provides a mechanism which produces an essentially self-balancing reclining chair. The invention may be adapted for use by any individual, regardless of size, shape or weight.

In the invention, the reclining chair has a base and two parallelogram linkages spaced apart from and facing each other in parallel vertical planes. Each parallelogram linkage has upper, lower, front and rear linkage arms pivotally connected to each other to define the parallelogram. A back support is mounted behind and between the rear linkage arms, a seat support is suspended below and between the lower linkage arms, and a leg support is suspended below and between the front linkage arms. The upper linkage arms are pivotally connected to the base, such that the chair may be balanced by positioning the pivotal connection at a position corresponding to the approximate center of gravity of the chair and an average person.

The pivoting points between the back support and the seat support are aligned with the person's hip joints. The pivoting points between the seat support and the leg support are aligned with the person's knee joints. The pivoting points between the rear and upper linkage arms are at the center of a quarter circle defined by the person's center of gravity in moving from an upright to horizontal position.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
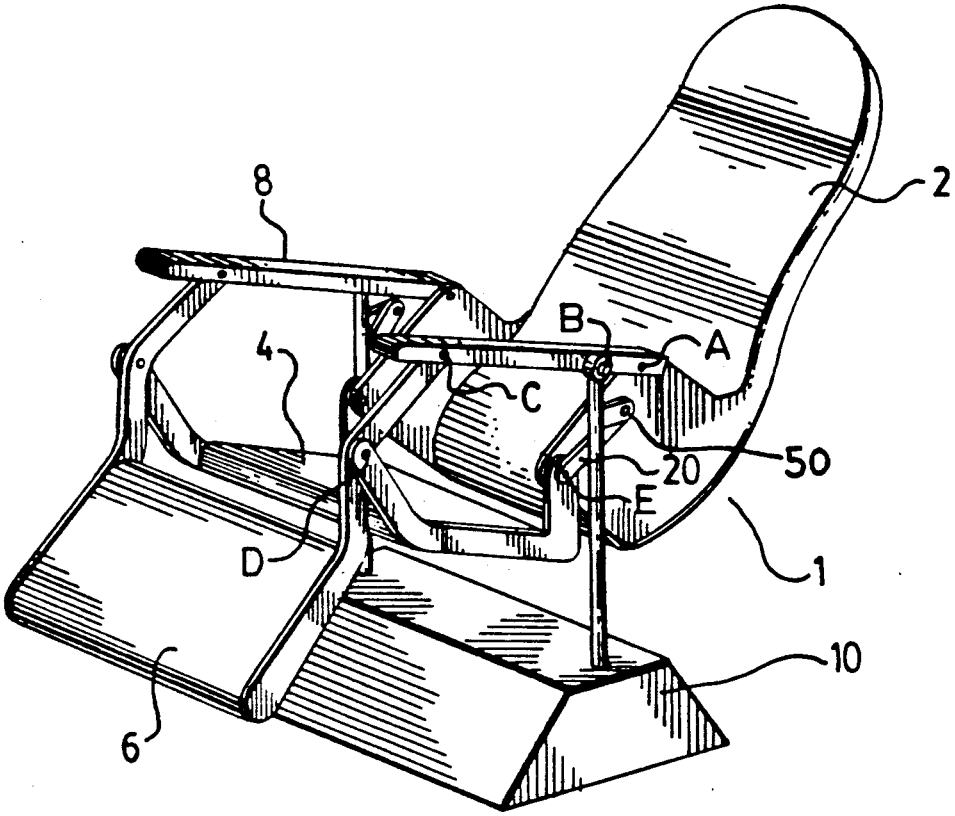
FIG. 1 is a perspective of a chair using the mechanism, with the chair shown in a slightly reclined position.
Figure 2:
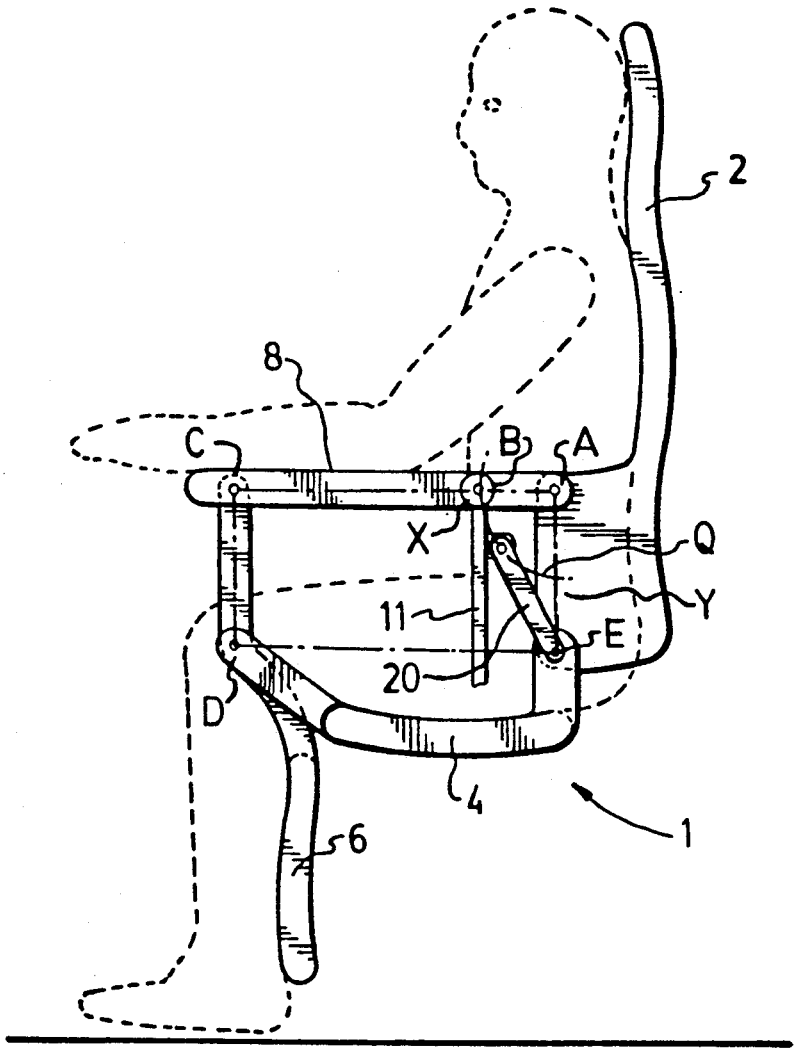
FIG. 2 is a side view of the chair of FIG. 1, showing the chair in the upright position.
Figure 3:
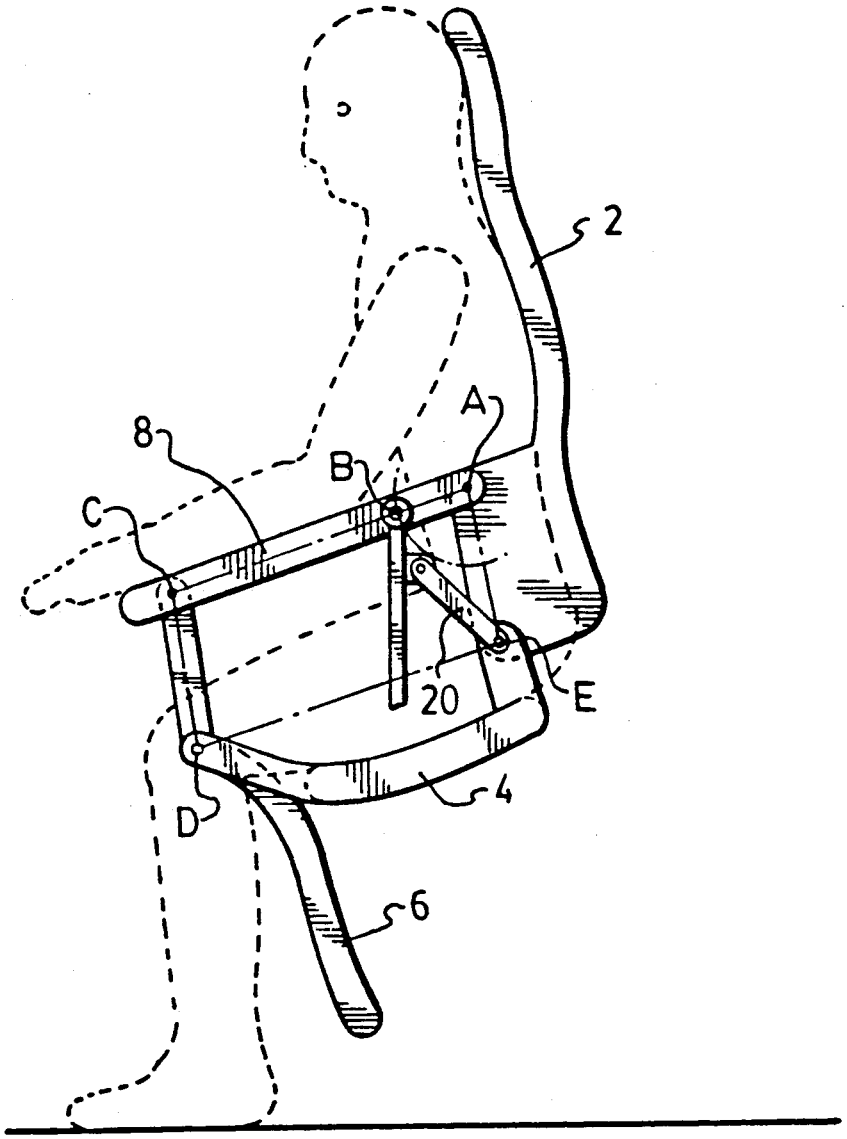
FIG. 3 is a side view, showing the chair tilted forward.
Figure 4:
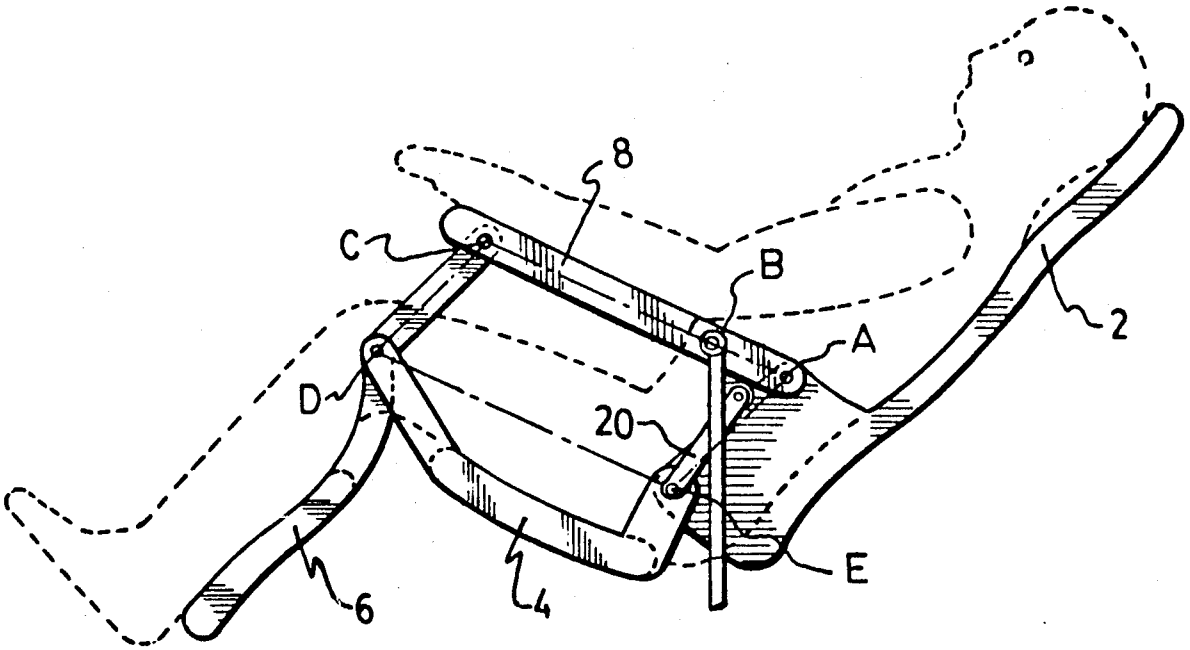
FIG. 4 is a side view, showing the chair partially reclined.
Figure 5:
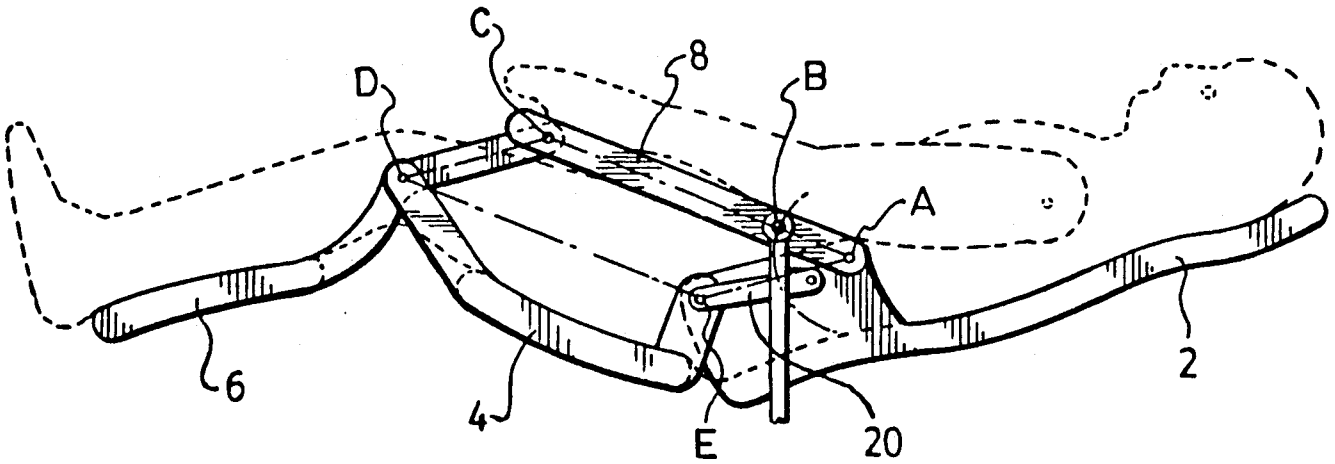
FIG. 5 is a side view, showing the chair fully reclined.

The basic parts of the chair 1 are a back support 2, a seat support 4, a leg support 6, arm supports 8, and a chair support base 10. The chair base could be, for example, a wheelchair base (manual or power driven), a moveable base with small wheels (hospitals, nursing homes, etc.), an office chair base (swivelling and moveable), or a standard non-moveable base. The base is not part of the invention as such; that is, it does not matter what base the chair mechanism is mounted on.

The mechanism which links the back support 2, seat support 4, leg support 6, and arm support 8 is a parallelogram linkage ACDE, best seen in FIGS. 2-5, one on each side of the chair, which provides for the balance of each body and chair part. The distances AC and DE correspond to the distance between the knee and hip joints of the body. The distances AE and CD are determined by the weight and size distribution of the individual.

An ideal or nearly ideal solution for any given individual can be obtained by matching the linkage dimensions to the individual. This would be particularly desirable for custom situations such as for persons confined to a wheelchair, or in other situations where the chair has only one user. On the other hand, by using measurements and center of gravity locations of the average U.S. male as indicated in publications such as the HUMANSCALE 1 2/3 Manual, or DESIGNERS: Henry Dreyfuss Associates, a solution can be obtained which provides the ideal solution for the average person, and nearly ideal for most other persons. Preferably but not essentially, some adjustability can be provided, so that the seller or the user can adjust the chair to suit the individual. Obviously, the more unusual the person's build, the more adjustability may be desirable.

In the invention, the desired zero-shear movement between the body and the chair is achieved by placing the pivoting points of the chair parts (back, seat, and leg rest) in the same location as the corresponding body parts (knee and hip joints). Thus as seen most clearly in FIGS. 2-5, pivot point E aligns with the person's hip joints, and pivot point D aligns with the person's knee joints. Thus the back support 2 is attached behind linkage AE, and the seat support 4 is attached below linkage DE. The leg support 6 is attached to or integral with linkage CD.

Figure 6:
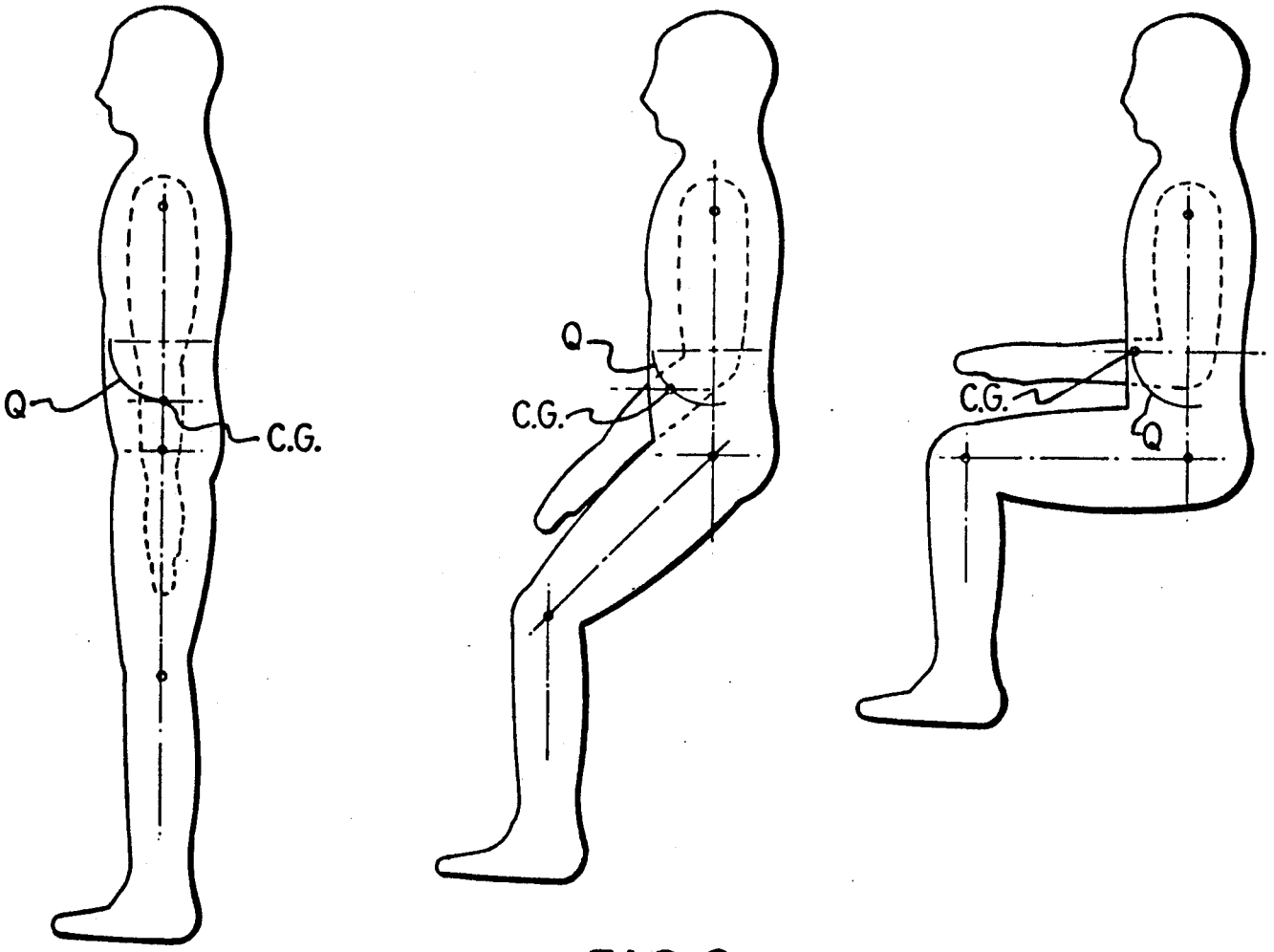
FIG. 6 is an illustration of how the center of gravity of a person between a standing and a sitting position.

Regarding the center of gravity, the main pivoting point B between the chair and its support should be located at the exact center of gravity of the combined total weight of the body and the chair. As shown in FIG. 6, this center of gravity changes considerably from a standing to a seated to a reclined position. Analysis has shown that the center of gravity, indicated as C.G. in FIG. 6, moves essentially in a quarter circle, as indicated by the quarter circle Q in FIG. 6. Thus in a sitting position, the person's center of gravity is at the upper front portion of the quarter circle. As the person reclines, i.e. as the person's body straightens out, the person's center of gravity follows the quarter circle down to the centerline of the body. To compensate for this movement of the center of gravity, the following solution is used in the invention. The pivoting point A between the upper linkage arm and the rear linkage arm is positioned at the center of this center of gravity quarter circle; the main pivoting point B between the chair and its base is located at the body center of gravity. The result will be that the chair, in any position, will stay fully balanced, i.e. the center of gravity of the person-chair combination remains at B. The position of points A and B is thus of primary importance in the design of a self-balancing, reclining chair.

The parallelogram linkage is such that the line AB between the body center of gravity and the center of the center-of-gravity quarter circle remains parallel to the hip-knee joint line DE. The center of the center of gravity circle stays on a line determined by the line through the hip joint and the center of gravity of the upper body.

Zero shear force (actual shear or sliding force between the body and chair parts) is achieved by matching the incline of the seat to the recline of the back support. That is, for any given back support recline angle, there is an optimum seat incline angle to prevent shear force. Although the chair may be perfectly balanced, there may be shear force if this matching does not take place, e.g. if the chair is tipped too far forward or backward from the optimum position.

Figure 7:
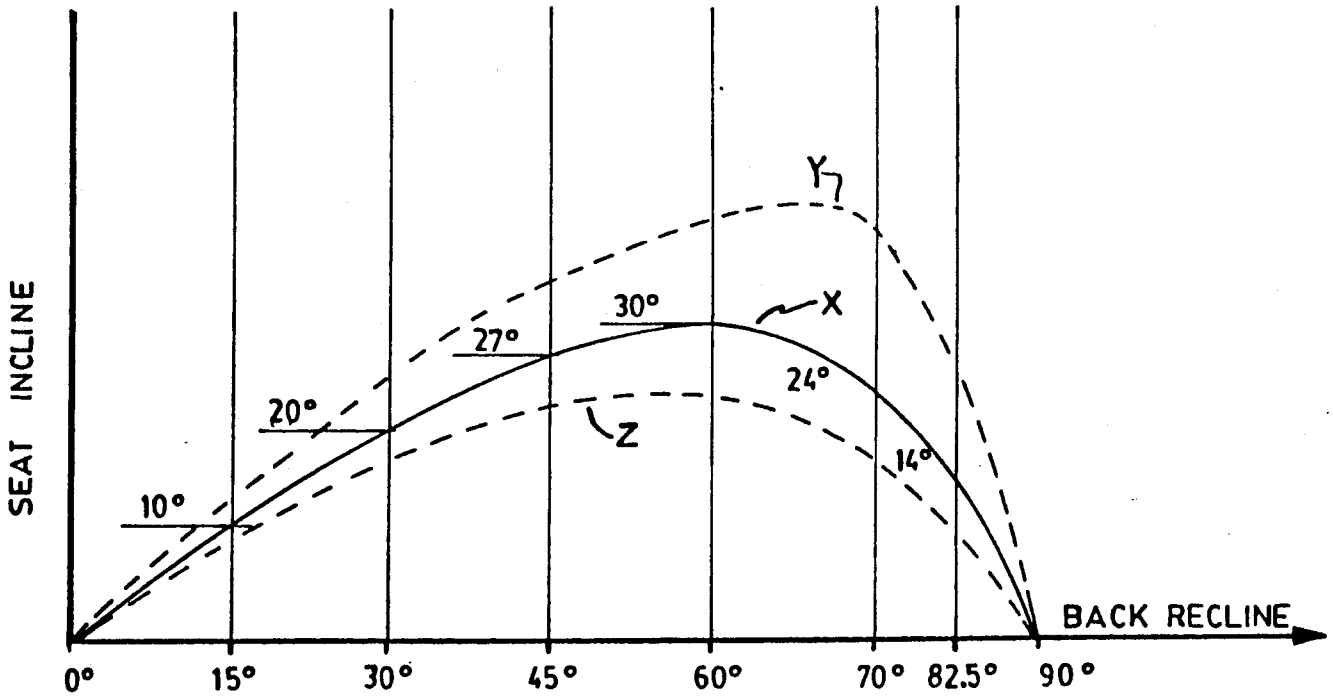
FIG. 7 is a graph showing the relationship between the chair back recline angle and the chair seat incline angle in different positions.

Through vector diagram calculations and/or actual experiments, the required incline of the chair seat may be established in relation to the recline of the chair back. FIG. 7 indicates this relationship between the chair back recline to the chair seat incline in different positions. Curve X represents the data for a weight ratio of 2:1 (upper body to lower body). Variations to this ratio results in a higher or lower seat incline to the back recline of the chair (see curves Y and Z). A higher ratio (e.g. heavy upper body) increases the chair seat incline (see curve Y). A lower ratio (e.g. lighter upper body) decreases the chair seat incline (see curve Z). Further calculations and experiments show that the ratio AE:AB coincides with the ratio of the weight distribution of the upper body to the lower body.

To ensure that the optimum back/seat angles are achieved, it is preferable to have a control mechanism. Otherwise, because the chair is so perfectly balanced or nearly so, the person can move from one position to another possibly too easily, i.e. almost inadvertently. A control mechanism is required for paraplegics or quadraplegics, to prevent inadvertent reclining. The control mechanism also acts to lock the chair in the desired position. It is a particular advantage of the invention that because the mechanism provides perfect or near-perfect balancing, the control mechanism requires very little force output. The only force output required is to overcome whatever friction is in the linkage joints, and to compensate for any minor deviations from perfect balancing. Thus it is possible to use a lever mechanism with a low mechanical advantage, or a very small low-power motor if desired (e.g. for a quadraplegic).

Figure 8:
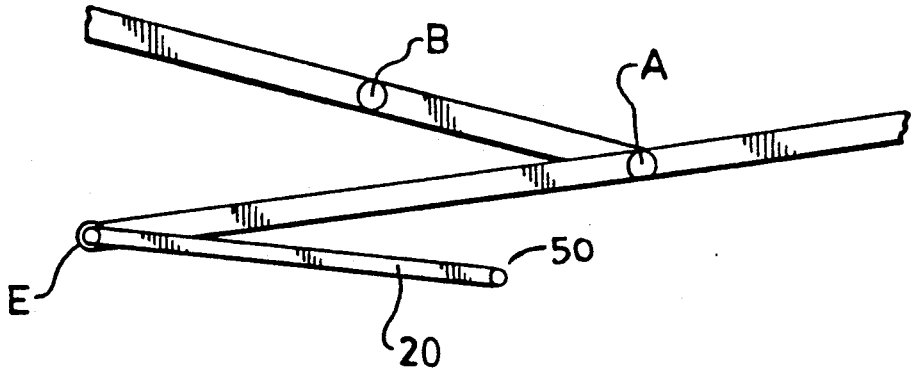
FIG. 8 is a side view showing a control arm for controlling the position of the chair.

A simple means of controlling the incline of the seat support in relation to the recline of the back support is the control arm 20 shown in FIG. 8. Without the control arm, the chair, being perfectly balanced, would be free to rotate through 360 degrees. The control arm ensures that the chair remains in the optimum position, i.e. where the seat incline matches the back recline angle properly for zero shear force.

Figure 9:
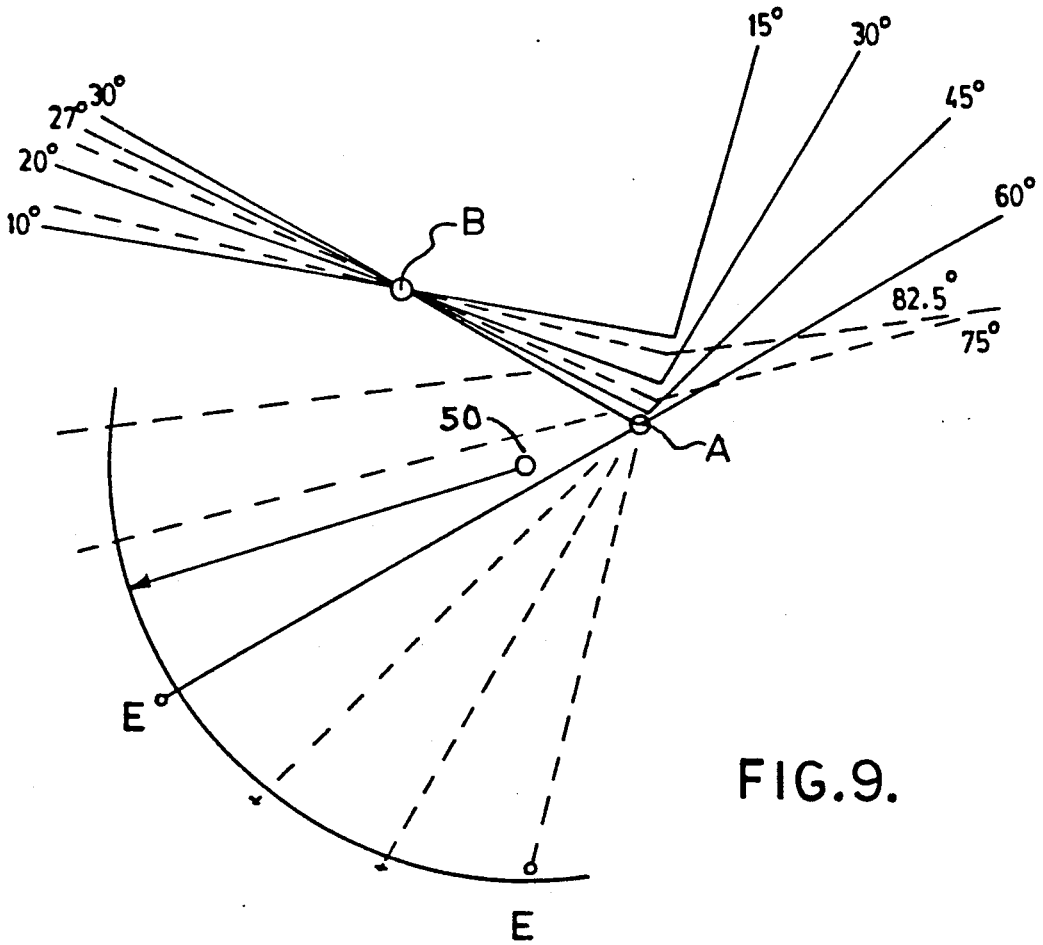
FIG. 9 is a chart showing the position of joint C in different reclining positions of the chair.

The control arm position is determined by the following. In the different reclining positions of the chair, joint E (the hip joint) follows a specific curve. This curve follows approximately a part of a circle, as illustrated in FIG. 9. The radius and the center 50 of this circle must be individually calculated. A mechanical connection between joint E (hip joint) and the center of this radius would thus control the incline of the seat to the recline of the back support. The control arm 20 provides that mechanical connection.

The operation of the control arm is difficult to visualize; essentially, it operates to ensure that for any given back recline angle, there is only one permissible location for pivot point E, and thus only one possible angular position of the chair about the main support point B. Without this control of the location of pivot point E, then as can perhaps be best visualized from FIG. 4, the chair could rotate freely about support point B—even through 360 degrees. It will therefore be readily appreciated that the chair could be locked in any given position by the simple expedient of locking the control arm. Similarly, the chair could be readily moved from position to position by the simple expedient of moving the control arm. An actuator mounted between the base and the control arm would obviously provide such means for moving and/or locking the control arm and thus the chair position.

The above combinations of solutions of design requirements result in a completely self-balancing recliner chair with zero shear movement and zero shear force in any position, thus satisfying the requirement that the body and chair parts should be in balance with each other in any position.

The chair can be adjusted for a particular individual without using a separate measuring chair. The procedure is as follows:

Step 1: The most comfortable chair parts (back, seat, and leg support) are selected to fit the individual.

Step 2: The individual on the chair seat. The pivoting points E and D (hip and knee joints) are located. The distance between points A and C is equal to the distance between E and D.

Step 3: The chair back rest and leg rest are positioned in a comfortable position against the body. The chair seat is connected at points D and E. A temporary arm rest is connected at points C and D. The distance of CD and AE are established later.

Step 4: The main pivoting point B (the center of gravity) is moved forward or backward until the chair is balanced in an upright position.

Step 5: The chair is tilted to its furthest reclining position. The distances CD and AE are shortened or lengthened simultaneously at C and A until the chair is balanced around pivoting point B.

At this point the chair is fully balanced for the specific individual. It is emphasized that individual adjustment is not essential, since the chair will function quite well for most people in an "average" position. Individual adjustment is more desirable where one person and one person only will be using the chair.

Figure 10:
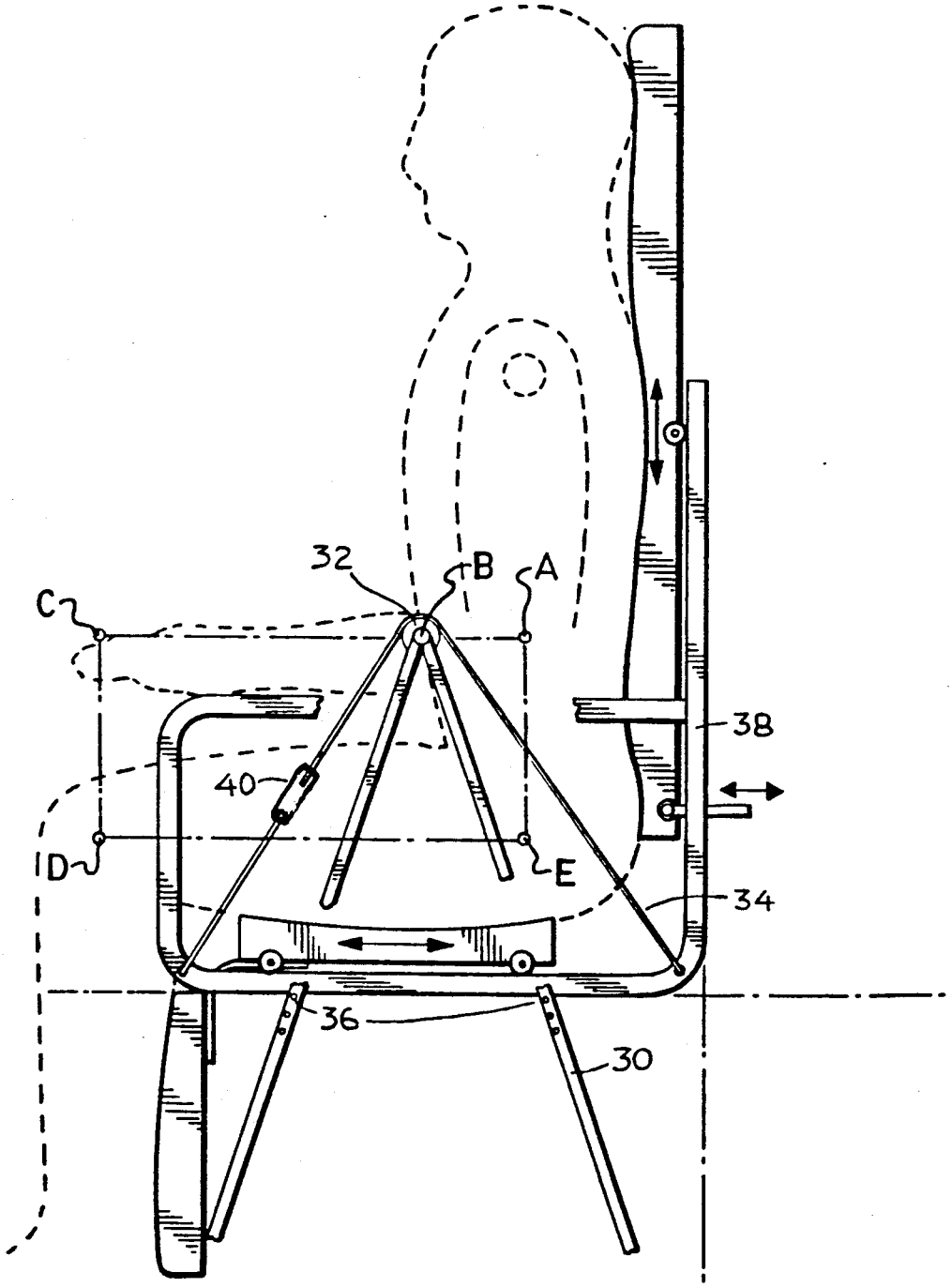
FIG. 10 is a side view of a special measuring chair which may be used if desired.

Alternatively, a special measuring chair may be employed, to facilitate individual adjustments and measurements for the reclining chair. As illustrated in FIG. 10, the measuring chair has a support frame 30. Rollers 32 are connected to the top of the frame, to suspend the cables 34. Moveable support pins 36 carry the chair frame 38. The cables 34 are connected to the lower corners of the chair frame to suspend it within the support frame. The chair frame supports the moveable back and seat rest and the leg support. The chair frame is used for reference lines (a and b) for the locations of the pivoting points of the actual chair. The seat and leg supports (optionally adjustable with respect to each other) are moveable horizontally on the chair frame. The back support is moveable on the chair frame vertically. The incline of the back support from a vertical position may be changed slightly. Each cable 34 has length adjustment means, such as a turnbuckle 40 for example, and suspends the chair frame with the cables hanging over the rollers, which are in turn fixed to the support frame.

The procedure with such a special measuring chair is as follows:

Step 1: The most comfortable chair parts (back, seat and leg supports) are selected to fit the individual.

Step 2: The individual is placed in an upright position on the seat and leg support. The seat and leg support is moved horizontally to position the person against the back support, which is then adjusted vertically and possibly tilted slightly to fit comfortably against the person. The supports are then clamped to the chair frame.

Step 3: The cable length adjustment means is then used to lengthen or shorten the cables to lower or raise the chair frame with respect to the support frame. The chair frame can be moved horizontally by turning on the rollers on the support frame.

Step 4: The chair frame is moved (horizontally and vertically) until the chair frame with the person is perfectly balanced. The support pins are kept slightly below the bottom of the chair frame to avoid excessive tipping.

Step 5: The locations of the body supports are measured against the reference lines.

Step 6: The hip joint E, knee joint D and center of gravity B are located against the reference lines. A parallelogram drawn on points E, D and B locates points A and C. The location of points A, B, C, D and E represents the desired pivoting point locations for the actual chair.

Figure 11:
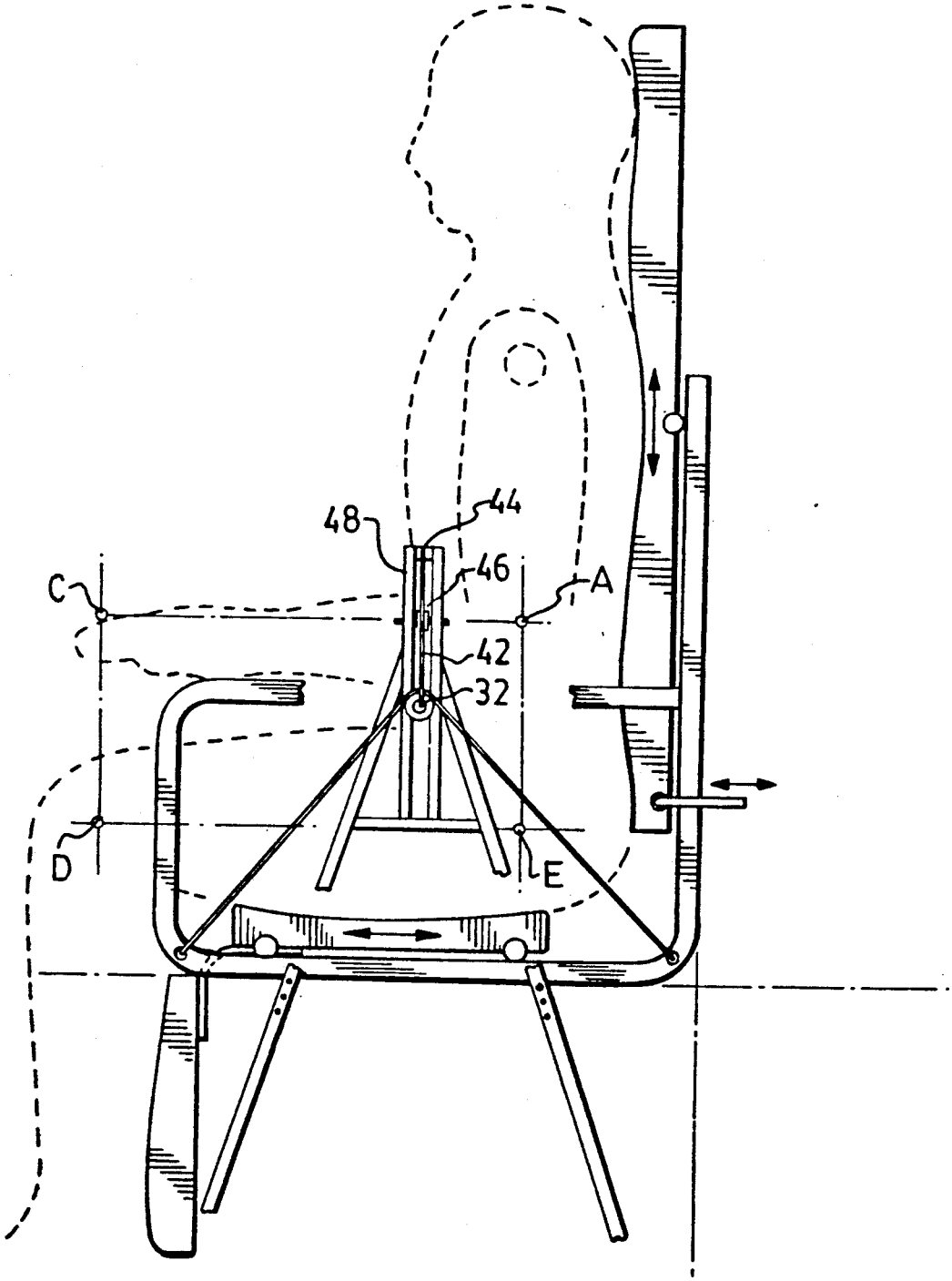
FIG. 11 is a side view of an alternative measuring chair.

As another alternative, instead of a measuring chair using cables, the measuring chair may be constructed in such a fashion that the main pivot point is moveable up and down, as shown in FIG. 11. In the FIG. 11 embodiment, the chair hangs from the rollers 32, one on either side. The rollers in turn hang from a short cable 42 which would be free to swing from upper pivot point 44, but for the bracket 46 which slides up and down on the frame member 48. The bracket 46 determines what point the chair swings about, and thus can be used to determine the main pivot point location.

It will be appreciated that the above description relates to the preferred embodiment by way of example only. Many variations on the invention will be obvious to those knowledgeable in the field, and such obvious variations are within the scope of the invention as described and claimed, whether or not expressly described.

In particular, it is emphasized that the mechanism can be used in a wide variety of seating applications. For example, without limiting the generality of the previous sentence, the mechanism could be applied to home furniture, wheelchairs, custom seating for the disabled, dentist's chairs, airline seat, and others.

What is claimed as the invention is:

1. A reclining mechanism for a chair, said reclining mechanism comprising:

two parallelogram linkages spaced apart from and facing each other in parallel vertical planes, each said parallelogram linkage comprising upper, lower, front and rear linkage arms pivotally connected to each other at pivot points, said pivot points constituting the corners of a parallelogram;

a back mounted behind a transverse plane defined by each of the pivot points of said rear linkage arms and between said rear linkage arms in a fixed relationship therewith;

a seat suspended below a transverse plane defined by each of the pivot points of said lower linkage arms and between said lower linkage arms in a fixed relationship therewith;

said front linkage arms having extensions reaching downwardly and forwardly;

a leg support suspended below and between said extensions in a fixed relationship therewith, behind and below a transverse plane defined by each of the pivot points of said front, linkage arms; and pivotal means for providing sole support for the chair at each upper linkage arm, alignable with a center of gravity of the chair with a person sitting therein, and substantially in alignment with the pivot points at each end of said upper linkage arms.

2. A reclining chair, comprising a chair base pivotally supporting the reclining mechanism of claim 1 at said pivotal means for providing support.

3. A reclining chair as recited in claim 2, further comprising a control arm on at least one of said parallelogram linkages, pivotally connected at one end thereof at said pivot point between said lower linkage arm and said rear linkage arm, and at the other end thereof at a point fixed with respect to said chair base and corresponding to the center of an arc described by the movement with respect to said chair base of said pivot point between said lower linkage arm and said rear linkage arm.

* * * * *